US012446653B2

(12) United States Patent
Corcoran-Tadd et al.

(10) Patent No.: US 12,446,653 B2
(45) Date of Patent: Oct. 21, 2025

(54) MIDSOLE FOR A SPORTS SHOE WITH BANKING EFFECT

(71) Applicant: adidas AG, Herzogenaurach (DE)

(72) Inventors: Fionn Corcoran-Tadd, Portland, OR (US); Ian James Hennebery, Portland, OR (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/394,791

(22) Filed: Dec. 22, 2023

(65) Prior Publication Data

US 2025/0204637 A1 Jun. 26, 2025

(51) Int. Cl.
*A43B 13/12* (2006.01)
*A43B 13/18* (2006.01)

(52) U.S. Cl.
CPC ..... *A43B 13/125* (2013.01); *A43B 13/187* (2013.01)

(58) Field of Classification Search
CPC ..... A43B 13/125; A43B 13/187
See application file for complete search history.

(56) References Cited

U.S. PATENT DOCUMENTS 1,052,441 A * 2/1913 Hazeltine ..... A43B 21/39 36/42
2,582,551 A * 1/1952 Malherbe ..... A43B 21/39 74/594.6
3,878,626 A 4/1975 Isman
4,118,034 A * 10/1978 O'Brien ..... A43B 1/0054 36/149
4,214,384 A * 7/1980 Gonzalez ..... A43B 21/39 74/594.6
4,610,100 A * 9/1986 Rhodes ..... A43B 21/39 36/36 A
5,025,574 A * 6/1991 Lasher, III ..... A43B 21/40 36/36 R
5,373,649 A * 12/1994 Choi ..... A43B 21/40 36/36 R
5,692,322 A * 12/1997 Lombardino ..... A43B 3/24 36/36 A
7,254,905 B2 * 8/2007 Dennison ..... A43B 7/18 36/15
7,600,332 B2 * 10/2009 Lafortune ..... A43B 17/18 36/43
7,900,379 B2 * 3/2011 Lafortune ..... A43B 23/042 36/43

(Continued)

FOREIGN PATENT DOCUMENTS

EP 4 176 753 A1 5/2023
EP 4 268 659 A1 11/2023
JP 2005-224335 A 8/2005

*Primary Examiner* — Bao-Thieu L Nguyen
(74) *Attorney, Agent, or Firm* — Sterne, Kessler, Goldstein & Fox P.L.L.C.

(57) ABSTRACT

Midsoles for a sports shoe that comprise a ground facing component comprising a rim portion with a first inward-facing wedge-shaped elongate protrusion and a foot support component arranged slidably at least partially inside the ground facing component. The foot support component may comprise a first outward facing wedge-shaped elongate recess configured to receive the first inward-facing wedge-shaped elongate protrusion of the ground facing component such that the foot support component tilts when sliding towards the rim portion of the ground facing component.

28 Claims, 11 Drawing Sheets

(56) References Cited

U.S. PATENT DOCUMENTS 8,069,583 B1 * 12/2011 Simchuk ..... A43B 21/39 36/31
8,225,532 B2 * 7/2012 Chen ..... A43B 17/02 36/15
8,540,544 B1 * 9/2013 Logue ..... A43B 3/105 446/101
8,640,362 B2 * 2/2014 Lafortune ..... A43B 17/18 36/43
9,044,066 B2 * 6/2015 Lafortune ..... A43B 17/18
9,756,904 B2 9/2017 Orand
9,877,544 B2 * 1/2018 Yamamoto ..... A43B 17/02
10,426,221 B2 * 10/2019 Leedy ..... A43B 13/181
10,485,300 B2 * 11/2019 Flowers ..... A43B 7/148
11,109,643 B2 * 9/2021 Foxen ..... A43B 13/181
2007/0186446 A1 * 8/2007 Lafortune ..... A43B 17/18 36/43
2010/0000125 A1 * 1/2010 Lafortune ..... A43B 7/1463 36/43
2010/0199526 A1 * 8/2010 Chen ..... A43B 17/02 36/58.6
2011/0146104 A1 * 6/2011 Lafortune ..... A43B 23/042 36/43
2014/0041256 A1 * 2/2014 Espinola ..... A43B 3/26 36/97
2014/0101971 A1 * 4/2014 Lafortune ..... A43B 13/40 36/88
2014/0290100 A1 * 10/2014 Flowers ..... A43B 7/144 12/146 B
2015/0157088 A1 6/2015 Seo
2016/0058122 A1 * 3/2016 Foxen ..... A43B 13/181 36/28
2016/0353839 A1 * 12/2016 Yamamoto ..... A43B 17/14
2017/0000215 A1 * 1/2017 Flowers ..... A43B 23/30
2019/0142110 A1 * 5/2019 Cruz ..... A43B 3/16 36/15
2020/0100568 A1 * 4/2020 Flowers ..... A43B 13/16
2021/0045497 A1 * 2/2021 Cruz ..... A43C 15/02

* cited by examiner

MIDSOLE FOR A SPORTS SHOE WITH BANKING EFFECT

1. TECHNICAL FIELD

The present disclosure relates to a midsole for a sports shoe providing a banking effect.

2. BACKGROUND

For many kinds of sports, and in various training drills cut movements, i.e., movements that involve a quick change of direction, are essential. A cut movement may also include acceleration in a mainly lateral or medial direction. Popular examples of cut movements are v-cuts in basketball or soccer, skater jumps in coordination- and endurance training and more generally side-shuffle movements.

The performance of cut movements is mainly limited due to injury preventive mechanisms. In particular, cut movements can lead to excessive inversion moments at the ankle joint caused by disadvantageous misalignment of foot and shank segments and, if the ankle joint is close to the limit of its range of motion, the ankle ligaments may be prone to injury.

Such a misalignment can be counteracted by creating a banking, which leads to an improved foot shank alignment and keeps the ankle joint out of dangerous positions, thus increasing the performance and the risk of injury. This protective mechanism has been termed banking effect and leads to an increased performance especially during cut movements.

Thus, a continuing need exists for innovations in footwear that supports efficient and safe cut movements.

3. BRIEF SUMMARY

Embodiments of the present disclosure comprise shoe soles that create a banking effect during abrupt movements, such as cut movements. The banking effect may be created by a slidable foot support element (also referred to herein as a foot support component) acted on by the horizontal force that occurs during such movements. The slidable element may comprise one or more wedge-shaped elements that transform horizontal force to vertical force.

A first embodiment (I) of the present disclosure is directed to a midsole for a sports shoe comprising a ground facing component comprising a rim portion with a first inward-facing wedge-shaped elongate protrusion, and a foot support component arranged slidably at least partially inside the ground facing component, wherein the foot support component comprises a first outward facing wedge-shaped elongate recess configured to receive the first protrusion of the ground facing component such that the foot support component tilts when sliding towards the rim portion of the ground facing component.

In a second embodiment (II), the elongate protrusion according to the first embodiment (I) extends at least partially in a metatarsal portion of the midsole.

In a third embodiment (III), the elongate protrusion according to the first embodiment (I) extends in a toe portion of the midsole.

In a fourth embodiment (IV), the rim portion of the ground facing component according to the first embodiment (I) comprises a second inward-facing wedge-shaped elongate protrusion and the foot support component comprises a second outward facing wedge-shaped elongate recess configured to receive the second protrusion of the ground facing component such that the foot support component tilts when sliding towards the rim portion of the ground facing component.

In a fifth embodiment (V), the first protrusion according to the fourth embodiment (IV) is arranged on a lateral side of the midsole and the second protrusion according to the fourth embodiment (IV) is arranged on a medial side of the midsole.

In a sixth embodiment (VI), the first wedge-shaped protrusion according to any one of embodiments (I)-(V) defines a first cross-sectional protrusion angle and the first wedge-shaped recess defines a first cross-sectional recess angle, and the first cross-sectional recess angle is smaller than the first cross-sectional protrusion angle. Additionally or alternatively, the second wedge-shaped protrusion according to the fourth embodiment (IV) defines a second cross-sectional protrusion angle and the second wedge-shaped recess defines a second cross-sectional recess angle, and the second cross-sectional recess angle is smaller than the second cross-sectional protrusion angle.

In a seventh embodiment (VII) the foot support component according to any one of embodiments (I)-(VI) comprises a compliant material.

In an eighth embodiment (VIII), the foot support component according to the seventh embodiment (VII) comprises a foam material.

In a ninth embodiment (IX), the foot support component according to any one of embodiments (I)-(VIII) is connected to the ground facing component by a compliant coupling such that the foot support component is movable relative to the ground facing component.

In a tenth embodiment (X), the compliant coupling according to the ninth embodiment (IX) is realized by a foam material and/or by a plurality of columns and/or bars and/or a lattice structure connecting the foot support component and the ground facing component.

In an eleventh embodiment (XI), the surface of the first recess according to any one of embodiments (I)-(X) is coated with a material having a lower friction than another material of the foot support component. Alternatively or additionally, the surface of the second recess according to the fourth embodiment (IV) is coated with a material having a lower friction than other materials of the foot support component.

In a twelfth embodiment (XII), the material according to the eleventh embodiment (XI) is co-molded with a portion of the foot support component forming the first and/or second recess.

In a thirteenth embodiment (XIII), the first protrusion according to any one of embodiments (I)-(XII) comprises a concave top surface. Additionally or alternatively, the second protrusion according to the fourth embodiment (VI) comprises a concave top surface.

In a fourteenth embodiment (XIV), the first protrusion according to any one of embodiments (I)-(XIII) may be compliant. Alternatively or additionally, the second protrusion according to the fourth embodiment (IV) may be compliant.

In a fifteenth embodiment (XV), the first protrusion according to any one of embodiments (I)-(XIV) comprises a void. Alternatively or additionally, the second protrusion according to the fourth embodiment (IV) comprises a void.

In a sixteenth embodiment (XVI), the voids according to the fifteenth embodiment (XV) are filled with a foam material.

In a seventeenth embodiment (XVII), the first protrusion according to any one of embodiments (I)-(XVI) forms a spring-like structure. Alternatively or additionally, the second protrusion according to the fourth embodiment (IV) forms a spring-like structure.

In an eighteenth embodiment (XVIII), the foot support component according to any one of embodiments (I)-(XVII) comprises an essentially circumferential rim portion protruding from an upper surface of the foot support component.

In a nineteenth embodiment (XIX), the foot support component according to any one of embodiments (I)-(XVIII) forms a footbed.

A twentieth embodiment (XX) of the present disclosure is directed to a sports shoe comprising a midsole according to any one of embodiments (I)-(XIX), and an upper.

In a twenty-first embodiment (XXI), the shoe according to the twentieth embodiment (XX) further comprises an outsole connected to the midsole.

In a twenty-second embodiment (XXII), the outsole according to the twenty-first embodiment (XXI) comprises a slidable outsole portion connected to the ground facing component.

In a twenty-third embodiment (XXIII), the slidable outsole portion according to the twenty-second embodiment (XXII) and a remaining outsole portion are configured such that the slidable outsole portion is movable relative to the remaining outsole portion.

In a twenty-fourth embodiment (XXIV), the outsole according to the twenty-first embodiment (XXI) is integral with the midsole.

In a twenty-fifth embodiment (XXV), the foot support component according to any one of embodiments (XXI)-(XXIV) comprises a first width and/or length and the outsole comprises a second width and/or length and, wherein the second width and/or length is larger than the first width and/or length.

In a twenty-sixth embodiment (XXVI), the shoe according to any one of embodiments (I)-(XXV) is a basketball shoe, a tennis shoe, a baseball shoe, a football shoe, an American football shoe, a volleyball shoe, or golf shoe.

4. BRIEF DESCRIPTION OF THE FIGURES

Embodiments of the present disclosure will be described in more detail with reference to the following Figures. Together with the description, the FIGS. further serve to explain the principles of and to enable a person skilled in the relevant art(s) to make and use the disclosed embodiments. These Figures are intended to be illustrative, not limiting. Although the disclosure is generally described in the context of these embodiments, it should be understood that it is not intended to limit the scope of the disclosure to these particular embodiments. In the Figures, like reference numbers indicate identical or functionally similar elements.

FIGS. 1A-B show cross-sections of a midsole for a sports shoe according to some embodiments.

FIGS. 4A-D illustrate various midsoles according to some embodiments.

FIG. 5A-D illustrate various midsoles according to some embodiments.

FIGS. 6A-E show a shoe according to some embodiments.

FIGS. 7A-E illustrate various wedge-shaped protrusions according to some embodiments.

Figure 8:
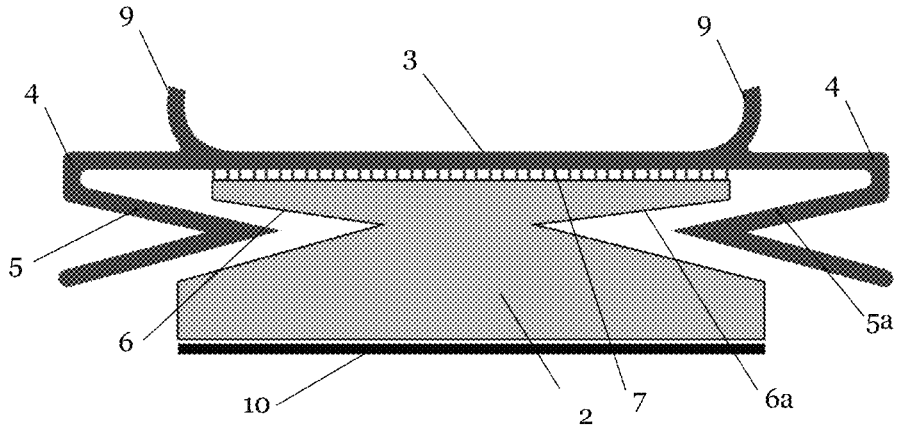

FIG. 8 illustrates a cross-section of a midsole for a sports shoe according to some embodiments.

5. DETAILED DESCRIPTION

The indefinite articles "a," "an," and "the" include plural referents unless clearly contradicted or the context clearly dictates otherwise.

The term "comprising" is an open-ended transitional phrase. A list of elements following the transitional phrase "comprising" is a non-exclusive list, such that elements in addition to those specifically recited in the list can also be present. The phrase "consisting essentially of" limits the composition of a component to the specified materials and those that do not materially affect the basic and novel characteristic(s) of the component. The phrase "consisting of" limits the composition of a component to the specified materials and excludes any material not specified.

Embodiments of the present disclosure are described in detail herein with reference to embodiments thereof as illustrated in the accompanying drawings, in which like reference numerals are used to indicate identical or functionally similar elements. References to "one embodiment," "an embodiment," "some embodiments," "in certain embodiments," etc., indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

In the following, only some possible embodiments of the disclosure are described in detail. However, the present disclosure is not limited to these, and a multitude of other embodiments are applicable without departing from the scope of the disclosure. The presented embodiments can be modified in a number of ways and combined with each other whenever compatible and certain features may be omitted in so far as they appear dispensable. In particular, the disclosed embodiments may be modified by combining certain features of one embodiment with one or more features of another embodiment.

It is to be understood that not all features of the described aspects/embodiments have to be present for realizing the technical advantages provided by the present disclosure, which is defined by the subject matter of the claims. The disclosed aspects/embodiments may be modified by combining certain features of one aspect/embodiment with one or more features of another aspect/embodiment. Specifically, the skilled person will understand that features, and/or functional elements of one aspect/embodiment can be combined with technically compatible features, and/or functional elements of any other aspect/embodiment of the present disclosure given that the resulting combination falls within the definition of the present disclosure.

Throughout the present figures and specification, the same reference numerals refer to the same elements. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

As understood by the skilled person and/or in order to avoid redundancies, reference is also made to the explanations in the preceding sections, which also apply to the following detailed description. Further, not all features, parts, elements, aspects, components and/or steps are expressly indicated by reference signs for the sake of brevity and clarity. This particularly applies, where the skilled person recognizes that such features, parts, elements, aspects, components and/or steps are present in a plurality.

Embodiments according to the present disclosure provide an improved sole structure designed to create a desired banking effect. As described herein, the disclosed embodiments provide a sole structure with a relatively large tilting angle, while at the same time providing a minimal risk of tilting of the ankle or injury in general. The described embodiments are designed to take advantage of a limited available vertical space while also creating the large tilting angle. And the described embodiments achieve the desired banking effect while maintaining foot shank alignment during a variety of different movements, thereby helping keep the ankle joint out of dangerous positions, and thus increasing performance and reducing risk of injury.

These advantages, as well as others discussed herein, can overcome problems or disadvantages of prior art sole structures. These advantages are achieved by the soles described herein, and in particular by the subject matter of the independent claims. Exemplary embodiments of the present disclosure are described herein. At least some of the exemplary embodiments are defined in the dependent claims A sole midsole for a sports shoe according to the present disclosure comprises a ground facing component comprising a rim portion with a first inward-facing wedge-shaped elongate protrusion, and a foot support component arranged slidably at least partially inside the ground facing component, wherein the foot support component comprises a first outward facing wedge-shaped elongate recess configured to receive the first protrusion of the ground facing component, such that the foot support component tilts when sliding towards the rim portion of the ground facing component.

Embodiments according to the present disclosure provide a simple mechanism for creating a banking effect during abrupt movements, such as cut movements, by exploiting the horizontal force component that occurs during such movements. This horizontal force component acts on the slidable foot support element which slides relative to the ground facing components such that the inward-facing wedge-shaped elongate protrusion of the ground facing component is received in the outward facing wedge-shaped elongate recess of the foot support component. This is used to create a vertical force that lifts the foot support component upwards such that it tilts relative to the ground facing component.

The term "inward-facing" as used in this disclosure means in the direction of the inside of the shoe. In contrast, the term "outward-facing" means in the direction of the outside of the shoe. Both terms denote opposite directions such that the wedge-shaped elongate protrusion faces the wedge-shaped elongate recess and both are generally configured such that the protrusion is received in the recess.

This mechanism has several advantages over the prior art. First, the foot support component does not rotate around a pivot point, which adds to the stability of the structure and reduces the vertical height of the midsole. Second, a banking effect does only occur under desired conditions during abrupt movements, such as cut movements, but not during linear movements such as running straight on at constant speed. Third, the achievable banking angles are higher compared to solutions that are only based on local differences in compressibility because the foot support element actively tilts.

The elongate protrusion may extend at least partially in a metatarsal portion of the midsole. In such embodiments, the location of the elongate protrusion in the front part of the midsole enhances the effect of banking as the forefoot portion of a foot is broader than the mid part and the rear part and thus exerts the largest force on the foot support component. Furthermore, during lateral movements, more pressure is usually exerted on the forefoot than on the rearfoot such that the banking effect is more pronounced. This particularly increases the performance of lateral movements that involve plantar flexion, that is, the extension at the ankle.

The elongate protrusion may additionally or alternatively extend in a toe portion of the midsole. Thus, in such embodiments, a banking effect can be achieved in the foremost portion of the shoe, which is advantageous during movements that push the foot towards the tip of the shoe.

The rim portion of the ground facing component may comprise a second inward-facing wedge-shaped elongate protrusion and the foot support component may comprise a second outward facing wedge-shaped elongate recess configured to receive the second protrusion of the ground facing component, such that the foot support component tilts when sliding towards the rim portion of the ground facing component. In this way, a banking effect in two different directions can be achieved. The directions may even be on opposite sides of the shoe. Further, the second protrusion may be arranged on the opposite side of the first protrusion. In this way, the foot support component tilts not only due to the second protrusion receiving the second wedge-shaped recess, but also due to the first protrusion partially leaving the first wedge-shaped recess. In other words, the foot support element is lifted at the side corresponding to the second protrusion and is lowered at the side corresponding to the first protrusion.

The first protrusion may be arranged on a lateral side of the midsole and the second protrusion may be arranged on a medial side of the midsole. Thus, a banking effect is achieved on both the lateral side and the medial side of the shoe, i.e. during cut movements to both sides. This improves the foot shank alignment during a variety of different movements and keeps the ankle joint out of dangerous positions, thus increasing the performance and reducing the risk of injury.

The first wedge-shaped protrusion may define a first cross-sectional protrusion angle and the first wedge-shaped recess may define a first cross-sectional recess angle, and the first cross-sectional recess angle is smaller than the first cross-sectional protrusion angle; and/or the second wedge-shaped protrusion may define a second cross-sectional protrusion angle and the second wedge-shaped recess may define a second cross-sectional recess angle, and the second cross-sectional recess angle is smaller than the second cross-sectional protrusion angle. A cross-sectional angle in the context of the present disclosure is the angle as measured in a cross-sectional view of the protrusion or the recess. If the angle of the protrusion is larger than the angle of the receiving recess, the recess is widened when receiving the protrusion and the foot support element is lifted upwards at least at an edge portion where the recess is located.

Figure 1A:
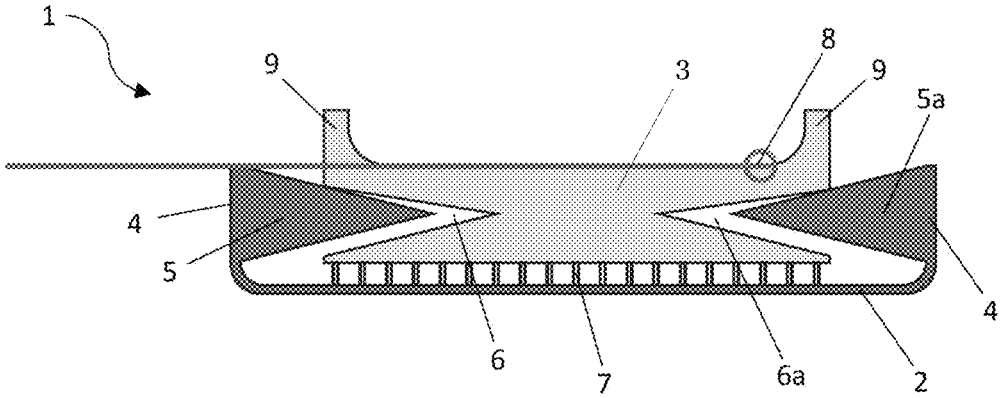
Figure 1B:
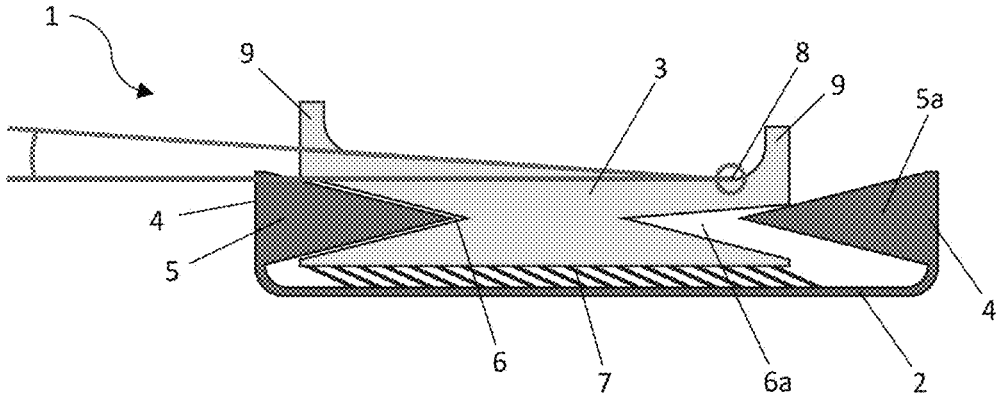

In some embodiments, as illustrated in for example FIGS. 1A and 1B, the first and/or second cross-sectional protrusion angle may range from greater than or equal to 30 degrees to less than or equal to 60 degrees. In some embodiments, the first and/or second cross-sectional recess angle may range from greater than or equal to 30 degrees to less than or equal to 60 degrees. In some embodiments, the first and/or second cross-sectional protrusion angle may range from greater than or equal to 5 degrees to less than or equal to 60 degrees. In some embodiments, the first and/or second cross-sectional recess angle may range from greater than or equal to 5 degrees to less than or equal to 60 degrees.

In some embodiments, the midsole may comprise a ground facing component comprising a rim portion with a first and/or second inward-facing wedge-shaped elongate protrusion, and a foot support component arranged slidably at least partially inside the ground facing component, wherein the foot support component comprises a first and/or second outward facing rectangular-shaped elongate recess configured to receive the first or second protrusion of the ground facing component, such that the foot support component tilts when sliding towards the rim portion of the ground facing component. In such embodiments, the first and/or second outward facing rectangular-shaped elongate recess may be a straight cut into the rim portion.

The first cross-sectional protrusion angle may be larger than a second cross-sectional protrusion angle. In this way, the tilting angle of the support component may be larger when sliding in a direction towards the first protrusion compared to sliding in a direction towards the second protrusion.

The foot support component may comprise a compliant material. This facilitates that the foot support element is able to lift upwards at least at its rim portion when receiving the protrusion. In some embodiments, the foot support element may comprise a movable rim portion, which would allow the rim portion to tilt upwards when receiving the protrusion. In some embodiments, the entire foot support element may be configured to tilt upwards. It is understood that the mentioned embodiments are not mutually exclusive and may be combined to obtain a new embodiment.

The foot support component may comprise a foam material. Foam material may provide the required compliance of the foot support element. In addition, it is readily available and easy to handle during manufacturing.

The foot support component may be connected to the ground facing component by a compliant coupling such that the foot support component is movable relative to the ground facing component. In this way, the foot support component does not separate from the ground facing component. Yet, both are movable relative to each other to achieve the banking effect as described herein.

The compliant coupling may be realized by a foam material and/or by a plurality of columns and/or bars and/or a lattice structure connecting the foot support component and the ground facing component. Alternatively or additionally, the compliant coupling may be realized by a sheet of polymer material having a low stiffness, e.g., by a silicone sheet. These solutions are relatively easy to realize during manufacturing, yet provide a sufficient coupling of both components and relative movability. Further, the compliant coupling provides a restoring force contributing to the return of the foot support element to its original position. The columns, bars or lattice structure may be 3D-printed, molded or injection molded.

The surface of the first recess may be coated with a material having a lower friction than another material of the foot support component, and/or the surface of the second recess may be coated with a material having a lower friction than other materials of the foot support component. The surface of the first protrusion may be coated with a material having a lower friction than another material of the ground facing component and/or the surface of the second protrusion may be coated with a material having a lower friction than another material of the ground facing component. Alternatively or additionally, the foot support element and/or ground facing component may be made from a low friction material. Thus, receiving the protrusion by the recess is facilitated and friction losses are minimized.

The material having a lower friction than another material of the foot support component may be co-molded with a portion of the foot support component forming the first and/or second recess. Thus, the material is firmly connected to the foot support component. Due to the co-molding, additional manufacturing steps of applying the material can be omitted. In case the foot support component comprising a foam, the material may be molded into the foam during a foam molding process through adding a film or insert to the mold that is baked into the foam during the foam compression molding. Alternatively or additionally, the foot support component may comprise a material that is cemented to the foam (or to the foot support component in general) after the foam is molded.

The first protrusion may comprise a concave top surface, and/or the second protrusion may comprise a concave top surface. This provides a non-linear banking effect, which may be small when a small horizontal force component acts on the foot support element and may become comparatively pronounced when the force is increased. Thus, the banking angle can be fine-tuned to the intensity of the movement. This could improve the experience for the athlete by better tuning the banking to his/her needs (i.e. less vertical displacement initially, and then a lot of vertical displacement in an extreme movement).

The first protrusion may comprise a concave top surface and the second protrusion may comprise an essentially flat top surface. Therein, an asymmetrical banking behavior may be realized. The concave shape will lead to a high restoring force at a maximum tilting angle when the cut movement is finished as the maximum gradient of the sliding surface is located on the outer portion of the concave top surface. Thus, pressure will now be exerted on this outer portion first. The gradient of the concave top surface on the inner portion is comparably smaller such that the restoring force acting on the foot support component is smaller. The advantage is that only tilting in one direction is allowed but at the same time a high restoring force is present to bring the foot support component back in a horizontal position after the cut movement is finished.

The first protrusion may be compliant, and/or the second protrusion may be compliant. This allows creation of a restoring force when the protrusion is received by the recess. In this situation, the compliant protrusion is compressed and the compression results in a restoring force or pressure that tries to push the protrusion out of the recess. In addition, a compliant protrusion does not negatively impact cushioning for the athlete during non-cutting movements. Thus, the midsole maintains its cushioning properties, yet create a banking effect as described herein. The compliant first and/or second protrusion may comprise a foam material. Additionally or alternatively, the compliant first and/or second protrusions may comprise compliant structures. For example, the protrusions may be made from a generally rigid material such as injection molded plastic or 3D printed material that can vertically deform under load.

The first protrusion may comprise a void, and/or the second protrusion may comprise a void. This saves material and weight. In addition, a void may result in a protrusion having a spring-like effect and/or being compliant with the advantages mentioned above.

The voids may be filled with a foam material. Thus, the cushioning properties of the midsole can generally be maintained. In addition, the foam material is compliant which results in the advantages mentioned above.

The first protrusion may form a spring-like structure, and/or the second protrusion may form a spring-like structure. In this way, the protrusions deform under load, i.e. when received by the recesses and return energy to the athlete as they exit the recesses. This may for example increase propulsion out of a cut movement to improve performance.

The foot support component may comprise an essentially circumferential rim portion protruding from an upper surface of the foot support component. The circumferential rim portion protruding from an upper surface of the foot support component may extend around all of a portion of the foot support component. The rim portion supports the foot especially during movements with horizontal acceleration such as cut movements. It also minimizes the slipping of the foot during such movements and helps to transfer horizontal forces from the foot onto the foot support element.

The foot support component may form a footbed. In some embodiments, the circumferential rim may define all of a portion of a perimeter of the footbed. Thus, the foot can directly rest on the foot support component to allow for an immediate force transfer.

Another aspect of the present disclosure relates to a sports shoe comprising a midsole as described herein and an upper. The technical properties shown or described for the midsole, its advantages and the improvements over the state of the art are likewise applicable to the shoe. Same applies vice versa.

The shoe may further comprise an outsole connected to the midsole. This increases the durability of the shoe as the outsole may be made from an abrasion resistant material while the midsole may provide cushioning and the banking effect described herein. In addition, the outsole may add to the traction of the shoe by comprising a corresponding material, a tread, cleats and/or spikes.

The outsole may comprise a slidable outsole portion connected to the ground facing component. In this way, both the outsole portion and the ground facing component can move relative to the foot support element. In addition, the slidable outsole portion can slide relative to the remaining portions of the outsole. Thus, the desired banking effect can be realized. Further, in this way, the slidable outsole portion and the ground facing component may only slide, when a certain share of the wearer's weight is loaded on the portion of the foot support component corresponding to the slidable outsole portion and/or the ground facing component. On the other hand, when the weight is distributed more evenly on the slidable outsole portion and the remaining portions of the outsole, the slidable portion may not be able to slide relative to the remaining portions. Hence, during linear movements, where such a more even distribution is typically present, the banking would be minimized and thus stability increases.

The slidable outsole portion and a remaining outsole portion may be configured such that the slidable outsole portion is movable relative to the remaining outsole portion. In this way, the advantages explained in the previous paragraph can be achieved.

The outsole may be integral with the midsole. In this way, the midsole and the outsole can be obtained in a single process step, for example co-molding. In addition, the bond between both components may be particularly strong.

The foot support component may comprise a first width and/or length and the outsole may comprise a first width and/or length and, wherein the second width and/or length is larger than the first width and/or length. For example, the outsole may be 2-20% wider and/or longer than the outsole. This allows the foot support component to have sufficient space in order to move relative to the ground facing component and/or the outsole.

The shoe may be a basketball, tennis, baseball, football, American football, volleyball or golf shoe. In those types of sports, movements with a horizontal acceleration such as cut movements regularly occur such that shoe soles according to embodiments of the present disclosure are particularly advantageous for those types of shoes. However, the present disclosure is not limited to these, and the shoe may be a sports shoe for any type of sports, where lateral movements occur.

FIGS. 1A and 1B illustrate a cross-section of a midsole 1 for a sports shoe according to some embodiments and illustrate the principle underlying the present disclosure. The longitudinal axis of the midsole 1 is perpendicular to the plane of projection. The midsole 1 comprises a ground facing component 2 and a foot support component 3. The ground facing component 2 is configured to face the ground while the foot support component is arranged above the ground facing component 2 and configured to support a foot of wearer. The ground facing component 2 may not necessarily contact the ground because an additional outsole may be attached to the ground facing component 2. Also, the foot support component 3 needs not necessarily directly contact a foot or sock of a wearer because an additional insole or sockliner may be arranged on top of the foot support component 3.

The ground facing component 2 comprises a rim portion 4 with one or more inward-facing wedge-shaped elongate protrusions 5. In the exemplary embodiment of FIGS. 1A-B, the ground facing component 2 also comprises one or more second inward-facing wedge-shaped elongate protrusions 5*a* but this is not required and other embodiments may comprise just one or more inward-facing wedge-shaped elongate protrusions.

The foot support component 3 comprises one or more first outward facing wedge-shaped elongate recesses 6 configured to receive the protrusion(s) 5. In the exemplary embodiment of FIGS. 1A-B, the foot support component 3 also comprises one or more second outward-facing wedge-shaped elongate recesses 6*a* matching the optional one or more second inward-facing wedge-shaped elongate protrusions 5*a* but this is not required and other embodiments may comprise just one or more outward-facing wedge-shaped elongate recesses.

The foot support component 3 is arranged slidably at least partially inside the ground facing component 2. "Slidably" means that the foot support component 3 can move relative to the ground facing component 2 in a horizontal direction, i.e. in a direction parallel to a bottom surface of the ground facing component 2. The foot support component 3 may be arranged to slide in a lateral direction, a medial direction, a forward direction, a rearward direction, or any combination of these two directions within the ground facing component 2. In the exemplary embodiment, midsole 1 may comprise one or more couplings 7, for example a plurality of flexible bars which connect the foot support component 3 and the ground facing component 2, that create a slidable attachment between the foot support component 3 and the ground facing component 2. In some embodiment, the bars may be arranged along a longitudinal direction of the midsole 1 such that they mainly allow a movement of the foot support component 3 relative to the ground facing component 2 in a lateral and a medial direction. The terms "lateral" and "medial" are defined based on the anatomy of the human foot. The medial side of the foot faces the midline of the body while the lateral side faces away from the midline of the body. The one or more couplings 7 may directly couple a ground-facing surface of foot support component 3 to an upper-facing surface of ground facing component 2.

FIG. 1A shows the foot support component 3 in a neutral position, for example while a wearer of the shoe comprising the midsole 1 is standing or running straight on, i.e. without any essential acceleration in a lateral or medial direction. Accordingly, an angle 8 formed between the foot support component 3 and the ground facing component 2 is zero degrees, which means that no banking effect occurs. In contrast, FIG. 1B illustrates the consequences of a lateral or medial acceleration of the foot relative to the ground. In this case, the foot pushes the foot support component 3 to the medial or lateral side of the midsole 1 relative to the ground facing component 2. The protrusion 5 is received by the recess 6 and pushes the foot support component 3 upwards on one side of the foot support component. Thus, the foot support component 3 is tilted relative to the ground facing component 2 and a non-zero angle 8 is formed between both components. To facilitate a transfer of horizontal forces from the foot to the foot support component, the foot support component 3 comprises a rim 9.

As depicted in the cross section of FIGS. 1A and 1B, the recess 6 (and 6*a*) has a smaller angle than the protrusion 5 (and 5*a*). Thus, the recess 6 (and 6*a*), when it receives the protrusion 5 (and 5*a*) is spread so that the height of the corresponding side of the foot support component increases relative to the opposing side not receiving a protrusion. To this end, the foot support component 3 is made from a compliant or flexible material such as a foam material. Alternatively or additionally, the foot support component could be made by 3D-printing to obtain a compliant structure formed e.g. from small beams.

Figure 2A:
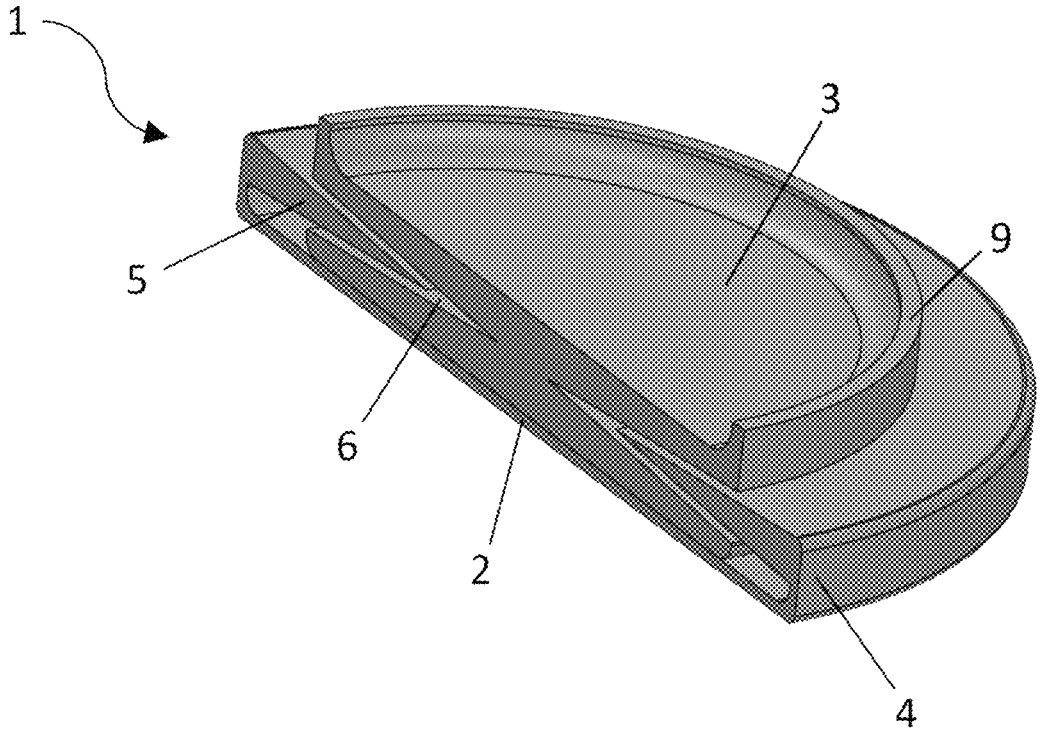
FIG. 2A shows a portion of a midsole according to some embodiments.

FIG. 2A depicts a portion of a midsole 1 according to some embodiments. In this example, the ground facing component comprises a single inward-facing wedge-shaped elongate protrusion 5 at its rim portion 4. The foot support component 3 comprises a corresponding outward-facing wedge-shaped elongate recess 6 matching the protrusion 5. The foot support component 3 and the ground facing component 2 in this example are not coupled by flexible bars as is the case in the embodiment of FIGS. 1A and 1B. Rather, the foot support component 3 rests on the ground facing component 2 and is slidable with respect to the ground facing component 2.

Figure 2B:
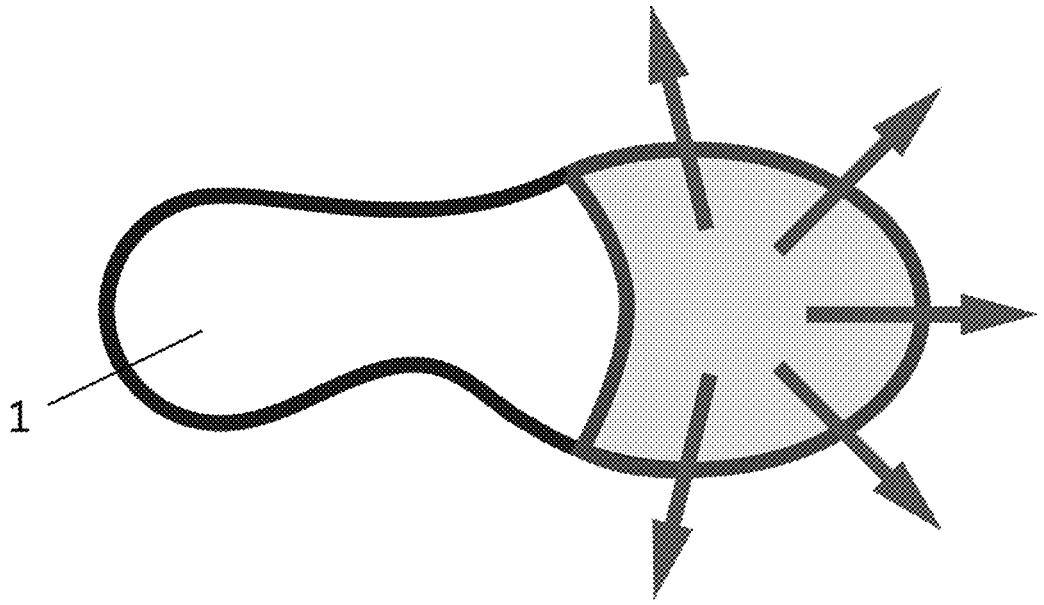
FIG. 2B illustrates the banking effect achieved according to embodiments of the present disclosure.

The protrusion 5 and corresponding recess 6 in the example of FIG. 2A may be arranged in a toe portion of the midsole 1 and define a semi-circular shape. This has the effect that the foot support component 3 may be tilted in different directions depending on the direction of pressure applied to the foot support component 3. For example, if a force moves the foot support component 3 towards the tip of the midsole 1 or shoe, the elongate recess 6 of foot support component 3 would receive a portion of the elongate protrusion 5 at the tip of the midsole. Consequently, the foot support component 3 would tilt upwards at just the tip of the midsole 1. If, in another example, the foot support component 3 is pushed to the medial or lateral side of the midsole 1 (similar to FIGS. 1A and 1B), the elongate recess 6 of the foot support component 3 would receive a portion of the elongate protrusion at the medial or lateral side of the midsole and the corresponding side of the foot support component 3 would tilt upwards. In this way, a banking in 180° or even greater can be realized depending on the direction of force applied to the foot support component 3 which in turn depends on the type of movement performed (e.g. medial of lateral cut movement or linear acceleration/stop). FIG. 2B exemplarily depicts the resulting multidirectional banking effect.

Figure 3:
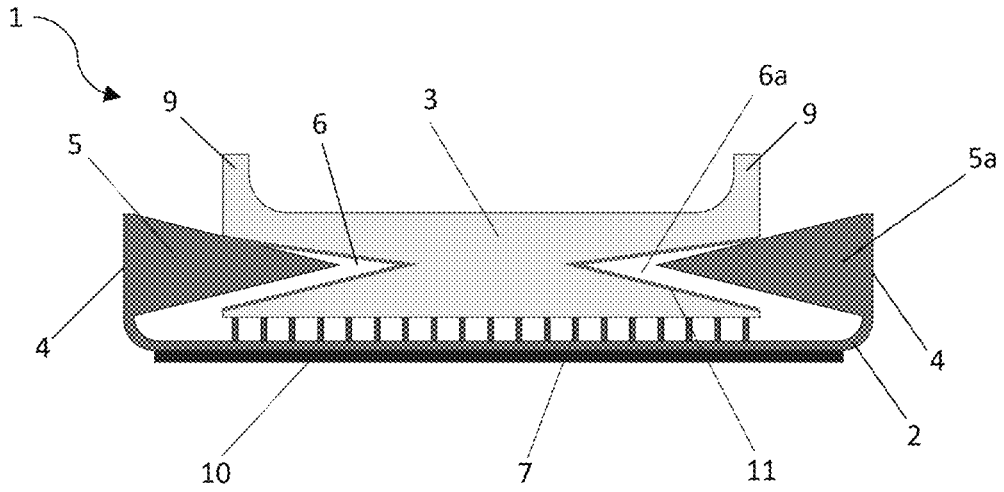
FIG. 3 illustrates a midsole according to some embodiments.

FIG. 3 illustrates a midsole 1 according to some embodiments. Midsole 1 shown in FIG. 3 is similar to the embodiment of FIGS. 1A and 1B. Hence, the description of FIGS. 1A and 1B applies to FIG. 3 as well. The embodiment of FIG. 3 shows an outsole 10 attached to the midsole 1. The outsole 10 may be integrally formed with the midsole 1, for example by way of co-molding. Alternatively, the outsole 10 may be attached to the midsole, e.g. by gluing. The outsole 10 may comprise a tread to increase the traction. The recesses 6 and 6*a* of the foot support component 3 comprise a low friction material 11, which lowers the friction with the protrusions 5 and 5*a*. The low friction material 11 may be a coating, e.g. based on POM, PEEK, PA, Nylon, PPS, PAI, PI, PTFE, a metal or a metal alloy such as brass, or an alloy comprising brass and graphite. Alternatively, the low friction material may be co-molded with the foot support component 3. In some embodiments, the wedge-shaped protrusions 5 may additionally or alternatively comprise a low friction material.

FIGS. 4A-D illustrate various embodiments of a midsole 1 according to the present disclosure. The figures show cross-sections of midsoles 1. The longitudinal axis of the midsole 1 is perpendicular to the plane of projection just like in the previous figures. The embodiments of FIGS. 4A-D are similar to the embodiment of FIGS. 1A and 1B. Therefore, the description of the embodiment of FIGS. 1A and 1B also applies to the embodiments of FIGS. 4A-D. The embodiments of FIGS. 4A-D differ in the way the wedge-shaped protrusions 5 and 5*a* are formed.

Figure 4A:
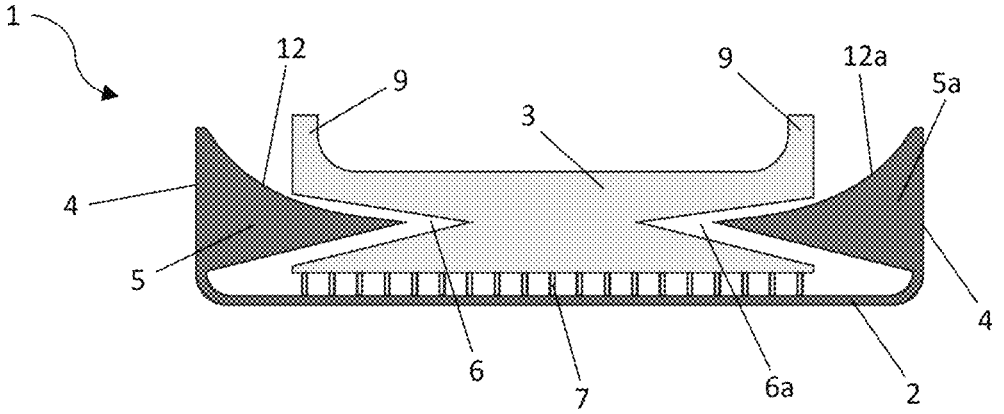

In the embodiment of FIG. 4A, the wedge-shaped protrusions 5 and 5*a* comprise concave top surfaces 12 and 12*a*, respectively. This creates a non-linear banking effect because when the foot support component 3 starts sliding relative to the ground facing component 2 it is initially in contact with a section of the concave surface 12, 12*a*, having a comparatively flat angle. Accordingly, the tilting or banking angle of the foot support component 3 relative to the ground facing component 2 starts to increase at a moderate level. As more and more of the protrusion 5, 5*a* is received in the corresponding recess 6, 6*a*, the angle of the surface 12, 12*a* becomes steeper and steeper. Accordingly, the tilting or banking angle of the foot support component 3 relative to the ground facing component 2 is subject to a stronger increase compared to the initial phase of banking.

In such embodiments, concave top surfaces 12 and 12*a* can create a slope that increases the first and/or second cross-sectional protrusion angle for protrusion 5, 5*a* towards lateral and medial sides of midsole. In some embodiments, concave top surfaces 12 and 12*a* can create a slope that increases the first and/or second cross-sectional protrusion angle to a maximum angle of 90 degrees.

Figure 4B:
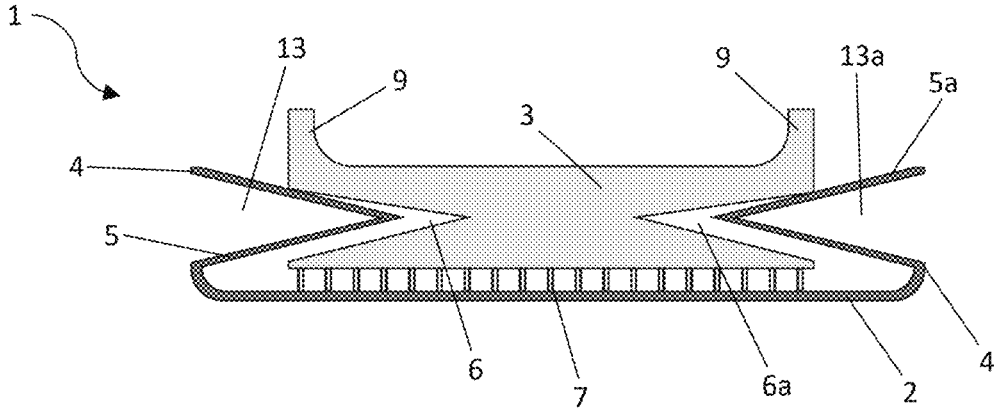

FIG. 4B illustrates an embodiment with spring-like wedge-shaped protrusions 5, 5*a*. The protrusions are not filled with material such that voids 13, 13*a* are formed in the protrusions 5 and 5*a*, respectively. In some embodiments, voids 13, 13*a* may comprise a hollow volume exposed on lateral and/or medial sides of the ground facing component 2. In some embodiments, voids 13, 13*a* may comprise a hollow volume enclosed by the wedge-shaped protrusions 5, 5*a*. When the protrusions 5, 5*a* are received in the corresponding recesses 6 or 6*a*, respectively, they are elastically deformed just like a spring. Accordingly, a restoring force builds up that pushes the protrusions 5, 5*a* out of the recesses 6, 6*a* such that the foot support component 3 returns to its original position.

Figure 4C:
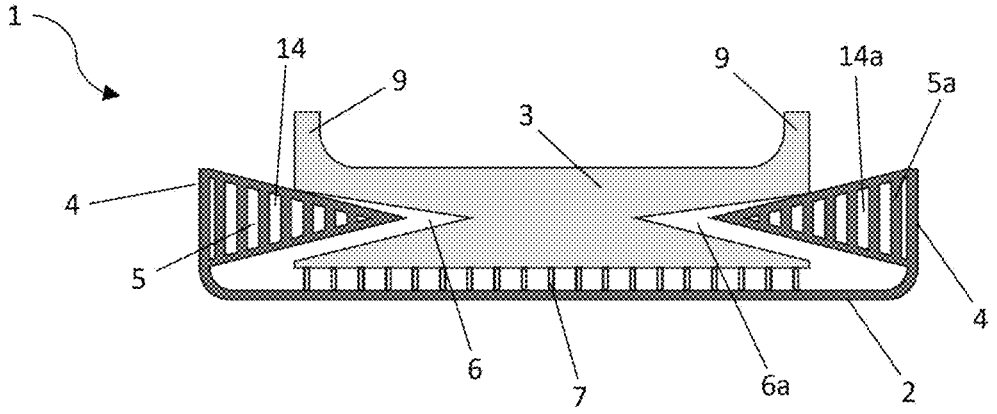

FIG. 4C shows an embodiment with compliant wedge-shaped protrusions 5, 5*a*. Compliance in this embodiment is achieved by a corresponding structure inside the protrusions 5, 5*a*, which in this example comprises multiple elongate bars that connect the top side of the corresponding protrusions and its bottom side. Accordingly, small voids 14, 14*a* are formed inside the protrusion 5, 5*a*, which allow the bars to deform under load, e.g. when the protrusions 5, 5*a* are received by the recesses 6, 6*a* or by a vertical force caused by a foot. This creates a restoring force similar to the embodiment of FIG. 4B. The structure inside the protrusions 5, 5*a* may be realized by 3D-printing, for example.

Figure 4D:
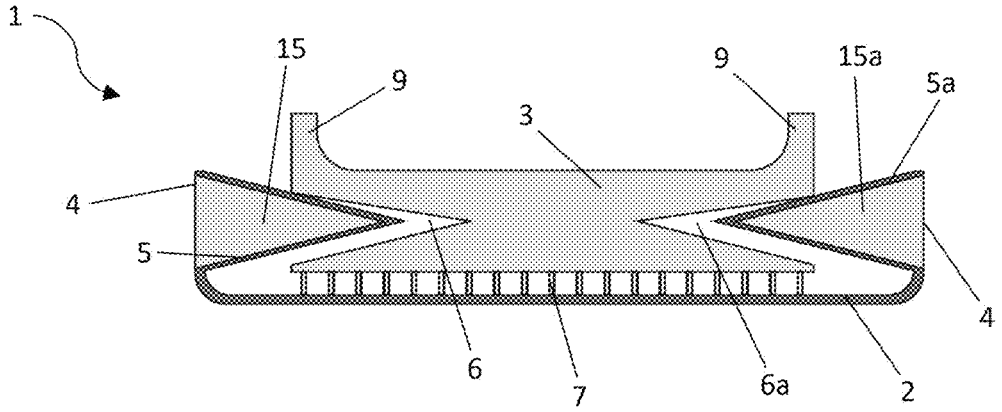

FIG. 4D illustrates another embodiment with compliant protrusions 5, 5*a*. In this case, the protrusions are filled with a compliant material such as a foam material. Similar to the embodiments of FIGS. 4B and 4C, a restoring force is created when the protrusions 5, 5*a* are received in the corresponding recess 6 or 6*a*. In some embodiments, the compliant material may be filled within the voids of the embodiments shown in FIGS. 4B and 4C.

FIGS. 5A-D illustrate various embodiments of a midsole 1 according to the present disclosure. The figures show cross-sections of midsoles 1. The longitudinal axis of the midsole 1 is perpendicular to the plane of projection just like in the previous figures. The embodiments of FIGS. 5A-D are similar to the embodiment of FIG. 3. Therefore, the description of the embodiment of FIG. 3 also applies to the embodiments of FIGS. 5A-D. The embodiments of FIGS. 5A-D differ in how the coupling 7 of the foot support component 3 to the ground facing component 2 is made.

Figure 5A:
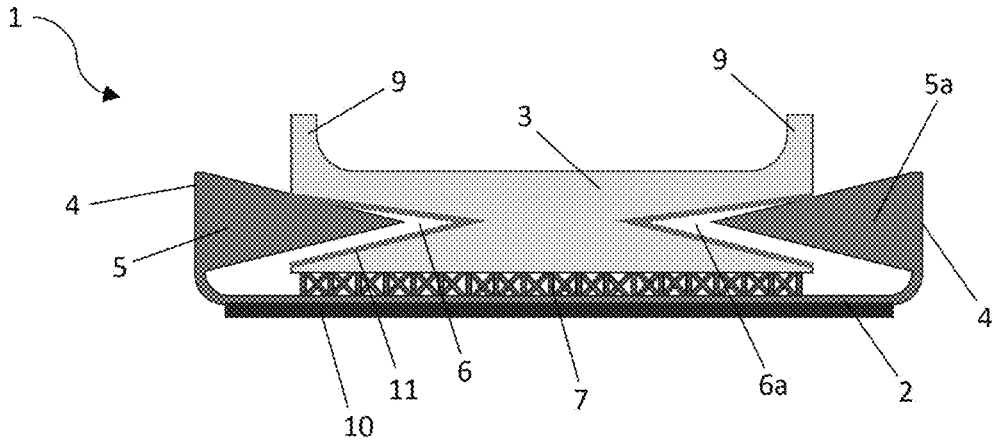

In FIG. 5A, the coupling 7 is achieved by a 3D-printed lattice structure. The lattice structure may be formed on the bottom surface of the foot support component 3 or on the top surface of the ground facing component 2. Alternatively, both components and the lattice structure in between may be formed in a single 3D-printing process. It is also possible to manufacture the lattice structure in a separate 3D-printing process and to attach it to the foot support component 3 and ground facing component 2 e.g. by gluing.

Figure 5B:
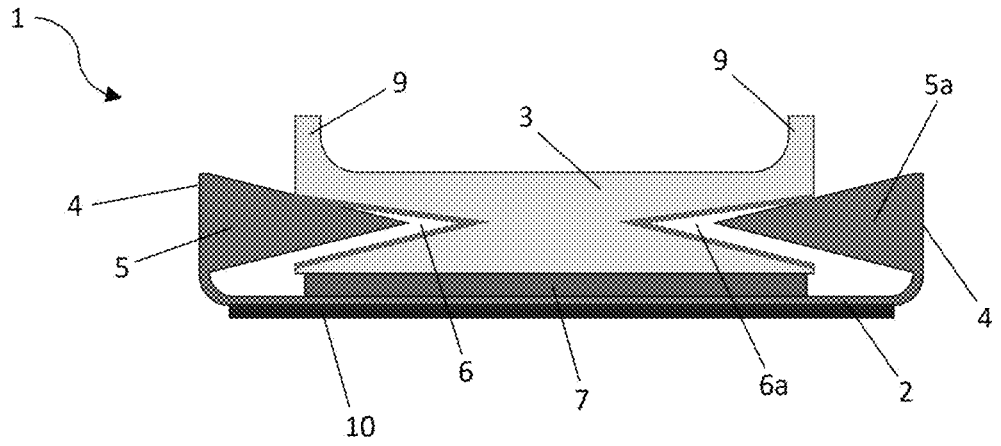

FIG. 5B shows an embodiment in which the coupling 7 between the foot support component 3 and the ground facing component 2 is made by a separate layer of compliant material. This can be realized for example by a foam or a gel. The compliant material may for example be glued to the foot support component 3 and the ground facing component 2.

Figure 5C:
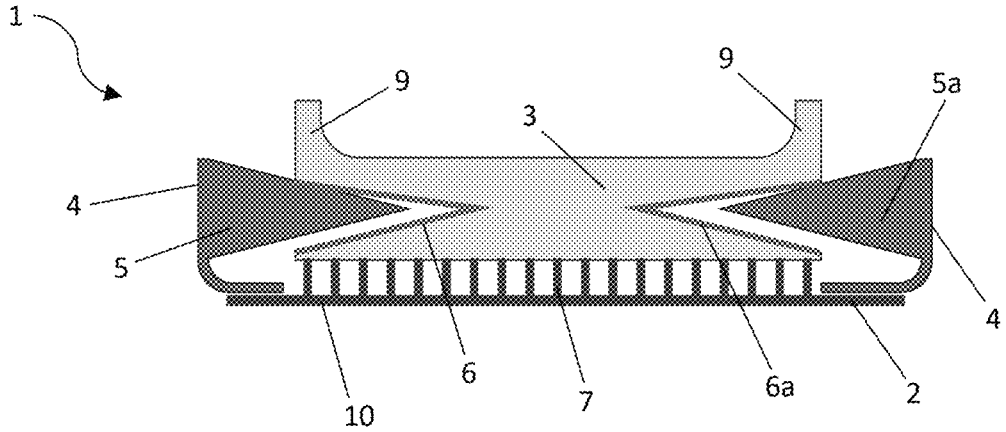

FIG. 5C shows an embodiment in which the ground facing component 2 also takes the function of the outsole 10 of the shoe. Thus, the ground facing component 2 is in contact with the ground. The ground facing component 2/outsole 10 extends up and forms a compliant coupling 7 to the foot support component 3. The compliant coupling 7 in this case is realized by a plurality of parallel bars that extend along a longitudinal axis of the shoe. Voids are formed between the bars such that the bars deform under horizontal loads which occur during lateral movements and a banking effect is created as described herein. The bars may also deform due to vertical force or pressure e.g. during linear running and provide cushioning to the shoe.

Figure 5D:
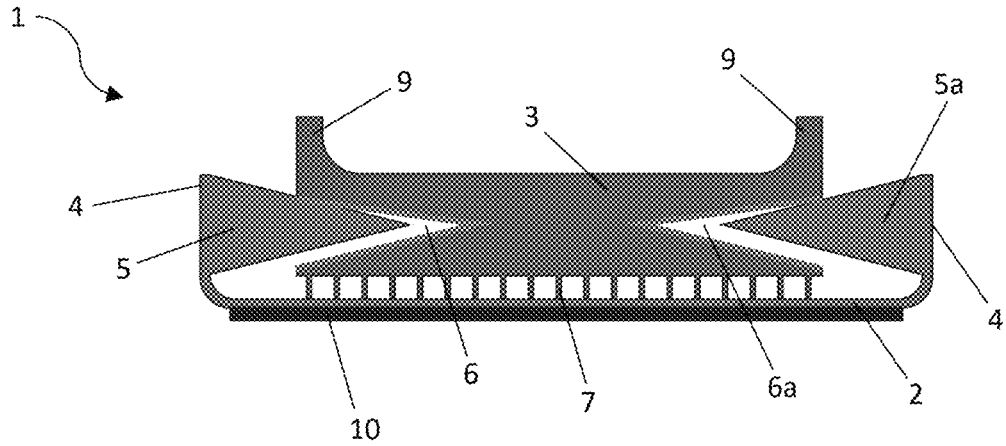

FIG. 5D illustrates an embodiment in which the coupling 7 between the foot support component 3 and the ground facing component 2 is realized by a secondary structure which is integral with the foot support component 3. Similar to the embodiment of FIG. 5C, the structure comprises a plurality of elongate bars with voids formed in between. The structure can for example be created during molding the foot support component. Alternatively, the foot support component 3 can be 3D-printed.

Figure 6A:
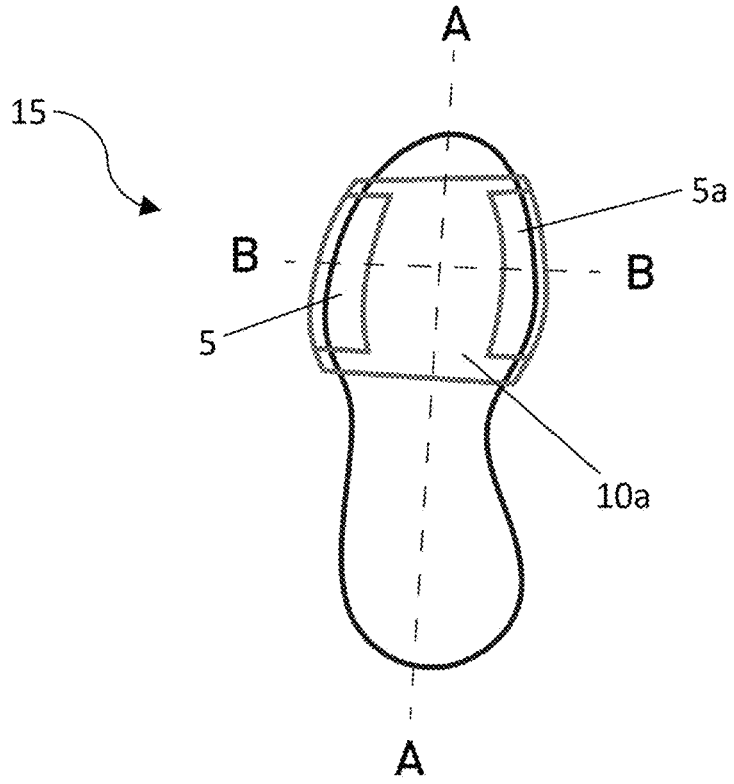
Figure 6B:
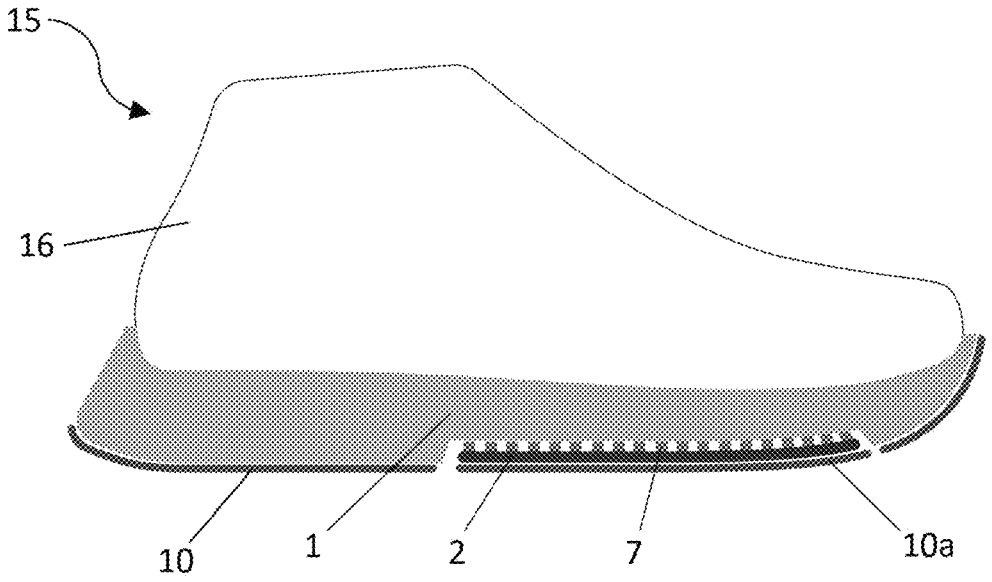
Figure 6C:
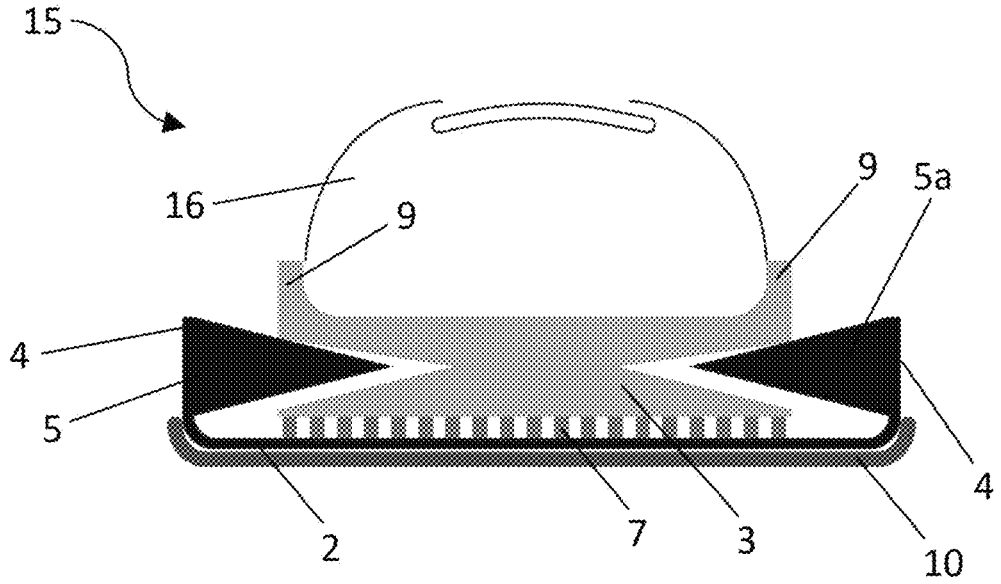
Figure 6D:
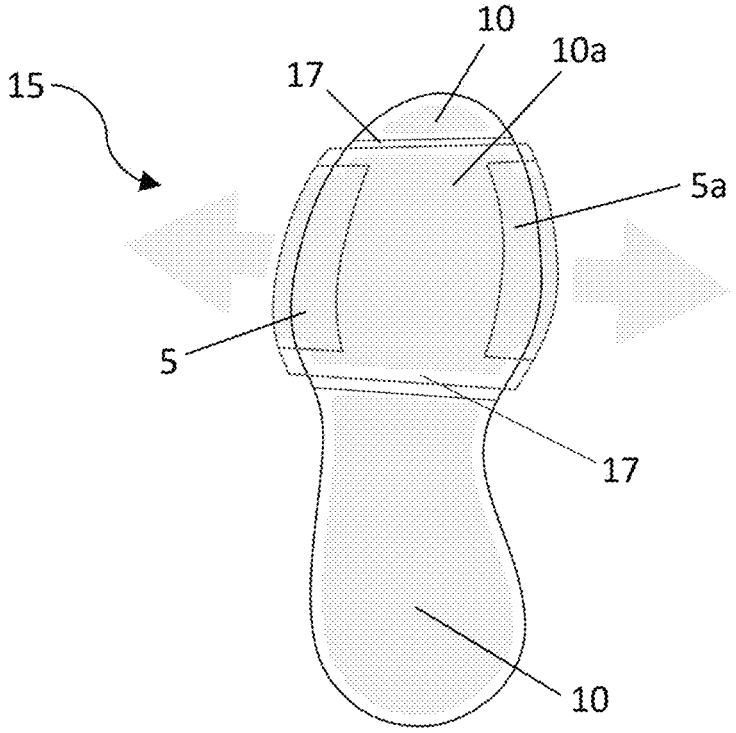

FIGS. 6A-E show an embodiment of a shoe 15 comprising a midsole 1 according to some embodiments. FIG. 6A illustrates a top view of the shoe 15. FIG. 6B illustrates a cross section along line A-A in FIG. 6A and FIG. 6C illustrates a cross section along line B-B in FIG. 6A. The shoe 15 comprises an upper 16, which is attached to the midsole 1. The upper is made in a conventional way, e.g. from a mesh material, a textile material, artificial leather, etc. The midsole 1 of this embodiment is similar to the previous embodiments. The coupling 7 between the foot support component 3 and the ground facing component 2 is made by a structure of elongate bars with voids formed in between. That said, any coupling 7 as described herein can be used. An outsole 10 is attached to the midsole. The outsole 10 comprises one or more slidable outsole portions 10*a* connected to the ground facing component 2 as illustrated in FIG. 6B. In this way, both the outsole portion 10*a* and the ground facing component 2 can move relative to the foot support component 3. In addition, the slidable outsole portion 10*a* can slide relative to the remaining portions of the outsole 10. In such embodiments, the remaining portions of the outsole 10 can be coupled a portion of midsole 1 that is not slidable as described herein for the ground facing component 2 and the foot support component 3. In such embodiments, one or more gaps 17 can be located between the slidable outsole portion 10*a* and the remaining portions of the outsole 10. For example, FIG. 6D illustrates that gaps 17 are formed between sections of the outsole section 10*a* and a front and rear section of the outsole 10. As the midsole is not covered by a single piece outsole, the portion of the midsole 1 comprising the wedge-shaped protrusions can move relative to the remaining portions of the midsole 1 as indicated by the arrows in FIG. 6D. Therein, the foot support component extends substantially along the full length of the shoe in longitudinal direction.

Figure 6E:
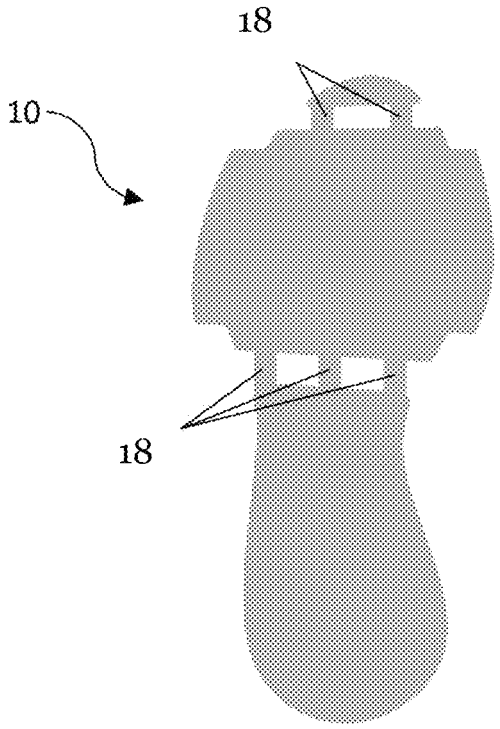

FIG. 6E illustrates an outsole 10 for the embodiment of FIGS. 6A-D. In this case, the sections of the outsole are connected by small stays 18, which still allow the sections of the outsole 10 to move relative to each other.

FIGS. 7A-E illustrate numbers and positions of wedge-shaped protrusions 5, 5*a*, 5*b*, 5*c* and 5*d* according to some embodiments. It is understood that the number and position of corresponding wedge-shaped recesses matches those of the protrusions.

Figure 7A:
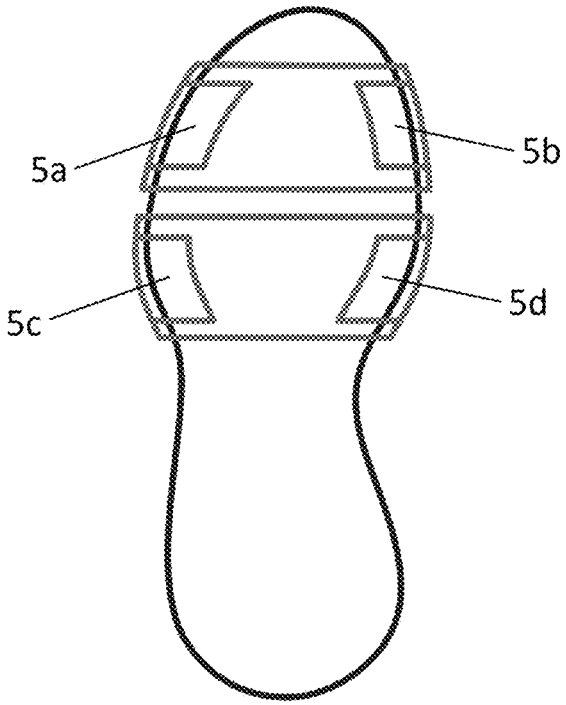

FIG. 7A illustrates an embodiment of a midsole having four wedge-shaped protrusions 5*a*, 5*b*, 5*c* and 5*d*. The protrusions (and corresponding recesses) 5*a*, 5*b*, 5*c* and 5*d* are located in a forefoot portion of the midsole with two lateral protrusions 5*a* and 5*c*, and two medial protrusions 5*b* and 5*d*. Thus, two wedge sections are formed which allow for forefoot flexion.

Figure 7B:
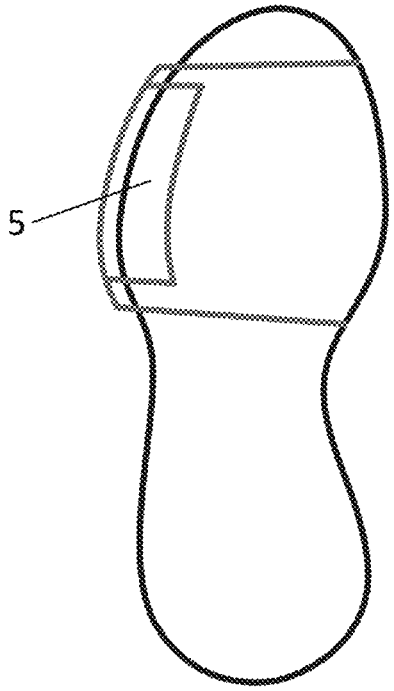

FIG. 7B illustrates an embodiment of a midsole with a single wedge-shaped protrusion 5 on the lateral side of the midsole. This allows for a banking effect in only the medial direction (because the lateral portion of the foot support element would bend upwards). In some embodiments, the protrusion 5 may be located on the medial side to allow banking only in the lateral direction.

Figure 7C:
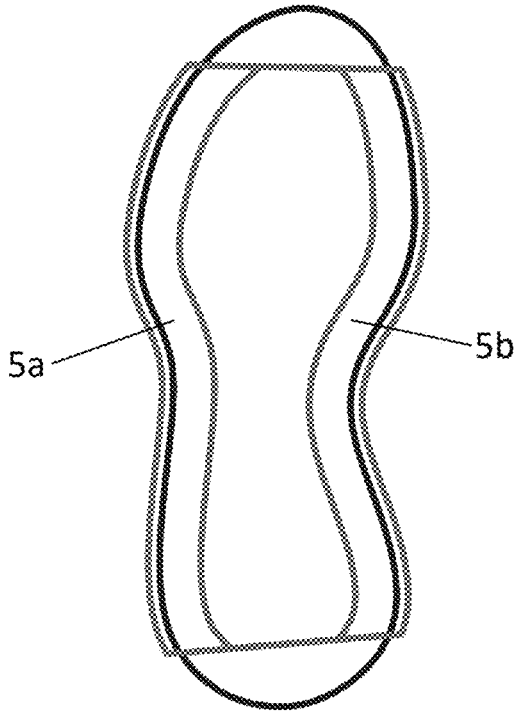

FIG. 7C illustrates an embodiment of a midsole with a lateral wedge-shaped protrusion 5*a* and a medial wedge-shaped protrusion 5*b*. Both protrusions extend along almost the entire length of the shoe. Thus, a banking effect is also created in the heel area (e.g. during the landing phase of a 90 degree cut).

Figure 7D:
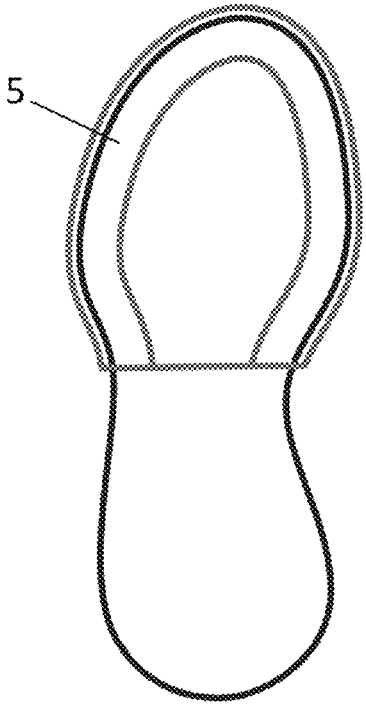

FIG. 7D illustrates an embodiment with a single wedge-shaped protrusion 5 that is located around the forefoot portion and allows for a banking effect in an angle of approximate 270°.

Figure 7E:
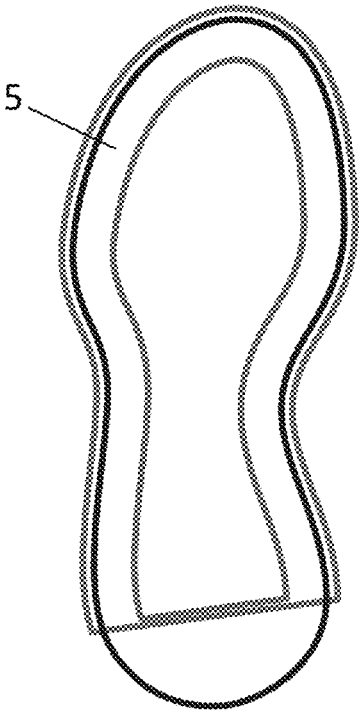

FIG. 7E illustrates an embodiment with a single wedge-shaped protrusion 5 that is located around the forefoot portion and extends along the lateral and medial side of the midsole. In the forefoot portion a multidirectional banking effect is achieved comparable to the embodiment of FIG. 7D. In addition, a banking effect is achieved at the entire lateral and medial sides. The presence of the wedge-shaped protrusion (and corresponding recess) in the toe area allows for a banking effect in only a longitudinal direction because the protrusion 5 would engage with the recess only at the toe area but not along the lateral land medial sides in case of longitudinal forces acting on the foot support element. Similarly, forces acting on the foot support element in a medial or lateral direction would cause the protrusions to engage with the recess only on the medial or lateral side, respectively, but not in the toe portion, such that a banking effect is only created at the sides but not at the toe portion.

The embodiments of FIGS. 7A-E can be combined to obtain embodiments with an arbitrary number of wedge-shaped protrusions (and corresponding wedge-shaped recesses) at arbitrary locations of a midsole according embodiments described herein.

In some embodiments, as shown for example in FIG. 8, the foot support component 3 comprises a rim portion 4 with an inward-facing wedge-shaped elongate protrusion 5. In the exemplary embodiment of FIG. 8, the foot support component 3 also comprises a second inward-facing wedge-shaped elongate protrusion 5*a* but this is not required and other embodiments may comprise just a single inward-facing wedge-shaped elongate protrusion. The ground facing component 2 comprises a first outward facing wedge-shaped elongate recess 6 configured to receive the protrusion 5. In the exemplary embodiment of FIG. 8, the foot support component 3 also comprises a second outward-facing wedge-shaped elongate recess 6*a* matching the optional second inward-facing wedge-shaped elongate protrusion 5*a* but this is not required and other embodiments may comprise just a single outward-facing wedge-shaped elongate recess. The ground facing component 2 comprises an outsole 10. As understood by the skilled person, features mentioned in the context of the previous embodiments of the present disclosure also apply to the embodiments illustrated in FIG. 8, as long as this is technically meaningful.

While various embodiments have been described herein, they have been presented by way of example, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail can be made to the embodiments disclosed herein without departing from the spirit and scope of the present disclosure. The elements of the embodiments presented herein are not necessarily mutually exclusive, but can be interchanged to meet various situations as would be appreciated by one of skill in the art.

The examples are illustrative, but not limiting, of the present disclosure. Other suitable modifications and adaptations of the variety of conditions and parameters normally encountered in the field, and which would be apparent to those skilled in the art, are within the spirit and scope of the disclosure.

It is to be understood that the phraseology or terminology used herein is for the purpose of description and not of limitation. The breadth and scope of the present disclosure should not be limited by any of the above-described exemplary embodiments, but should be defined in accordance with the following claims and their equivalents.

What is claimed is:

1. A midsole for a sports shoe, comprising:

a ground facing component comprising a rim portion with a first inward-facing wedge-shaped elongate protrusion; and a foot support component arranged slidably at least partially inside the ground facing component, wherein the foot support component comprises a first outward facing wedge-shaped elongate recess configured to receive the first protrusion of the ground facing component, such that the foot support component tilts relative to the ground facing component when sliding in a lateral or medial direction relative to the ground facing component.

2. The midsole of claim 1, wherein the elongate protrusion extends at least partially in a metatarsal portion of the midsole.

3. The midsole of claim 1, wherein the elongate protrusion extends in a toe portion of the midsole.

4. The midsole of claim 1, wherein the rim portion of the ground facing component comprises a second inward-facing wedge-shaped elongate protrusion and the foot support component comprises a second outward facing wedge-shaped elongate recess configured to receive the second protrusion of the ground facing component, such that the foot support component tilts relative to the ground facing component when sliding in the lateral or medial direction relative to the ground facing component.

5. The midsole of claim 4, wherein the first protrusion is arranged on a lateral side of the midsole and the second protrusion is arranged on a medial side of the midsole.

6. The midsole of claim 1, wherein:

the first wedge-shaped protrusion defines a first cross-sectional protrusion angle and the first wedge-shaped recess defines a first cross-sectional recess angle, and the first cross-sectional recess angle is smaller than the first cross-sectional protrusion angle.

7. The midsole of claim 1, wherein the foot support component comprises a compliant material.

8. The midsole of claim 7, wherein the foot support component comprises a foam material.

9. The midsole of claim 1, wherein the foot support component is connected to the ground facing component by a compliant coupling such that the foot support component is movable relative to the ground facing component.

10. The midsole of claim 9, wherein the compliant coupling comprises one or more of a foam material, a plurality of columns and/or bars, or a lattice structure connecting the foot support component and the ground facing component.

11. The midsole of claim 1, wherein the surface of the first recess is coated with a material having a lower friction than another material of the foot support component.

12. The midsole of claim 11, wherein the material is co-molded with a portion of the foot support component forming the first recess.

13. The midsole of claim 1, wherein the first protrusion comprises a concave top surface.

14. The midsole of claim 1, wherein the first protrusion is compliant.

15. The midsole of claim 1, wherein the first protrusion comprises a void.

16. The midsole of claim 15, wherein the void is filled with a foam material.

17. The midsole of claim 1, wherein the first protrusion forms a spring-like structure.

18. The midsole of claim 1, wherein the foot support component comprises an essentially circumferential rim portion protruding from an upper surface of the foot support component.

19. The midsole of claim 1, wherein the foot support component forms a footbed.

20. A sports shoe comprising:

the midsole of claim 1; and an upper.

21. The shoe of claim 20, further comprising an outsole connected to the midsole.

22. The shoe of claim 21, wherein the outsole comprises a slidable outsole portion connected to the ground facing component.

23. The shoe of claim 22, wherein the slidable outsole portion and a remaining outsole portion are configured such that the slidable outsole portion is movable relative to the remaining outsole portion.

24. The shoe of claim 21, wherein the outsole is integral with the midsole.

25. The shoe of claim 21, wherein the foot support component comprises a first width and/or length and the outsole comprises a second width and/or length, and wherein the second width and/or length is larger than the first width and/or length.

26. The shoe of claim 20, wherein the shoe is a basketball shoe, a tennis shoe, a baseball shoe, a football shoe, an American football shoe, a volleyball shoe, or a golf shoe.

27. The midsole of claim 1, wherein the first outward facing wedge-shaped elongate recess defines a space between the ground facing component and the foot support, wherein the first inward-facing wedge-shaped elongate protrusion is configured to close the space when the foot support component slides in the lateral or medial direction relative to the ground facing component.

28. A midsole for a sports shoe, comprising:

a ground facing component comprising a rim portion with a first inward-facing wedge-shaped elongate protrusion; and a foot support component arranged slidably at least partially inside the ground facing component, wherein the foot support component comprises a first outward facing wedge-shaped elongate recess configured to receive the first protrusion of the ground facing component, the first outward facing wedge-shaped elongate recess defining a space between the ground facing component and the foot support, and wherein the first inward-facing wedge-shaped elongate protrusion is configured to close the space when the foot support component slides towards the rim portion of the ground facing component.

* * * * *